US012644595B2

(12) United States Patent
Lim et al.

(10) Patent No.: US 12,644,595 B2
(45) Date of Patent: Jun. 2, 2026

(54) BURNER AND WATER HEATING APPARATUS INCLUDING SAME

(71) Applicant: KYUNGDONG NAVIEN CO., LTD., Pyeongtaek-si (KR)

(72) Inventors: Jae Beom Lim, Seoul (KR); Jun Kyu Park, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 378 days.

(21) Appl. No.: 18/210,781

(22) Filed: Jun. 16, 2023

(65) Prior Publication Data

US 2024/0003536 A1 Jan. 4, 2024

(30) Foreign Application Priority Data

Jun. 29, 2022 (KR) ..... 10-2022-0079738

(51) Int. Cl.
*F23D 14/82* (2006.01)
*F23D 14/02* (2006.01)
(Continued)

(52) U.S. Cl.
CPC ..... *F23D 14/02* (2013.01); *F23D 14/84* (2013.01); *F23N 5/242* (2013.01); *F24H 1/0027* (2013.01); *F23N 2225/16* (2020.01)

(58) Field of Classification Search
CPC ..... F23D 14/02; F23D 14/14; F23D 14/145; F23D 14/82; F23D 2203/105; F24H 9/005
See application file for complete search history.

(56) References Cited

U.S. PATENT DOCUMENTS

2007/0243444 A1 10/2007 Zheng et al.
2009/0197141 A1 8/2009 Nakakubo
(Continued)

FOREIGN PATENT DOCUMENTS

CN 104315515 B * 5/2017 ..... F23D 14/02
CN 113007708 A * 6/2021 ..... F24C 3/085
(Continued)

OTHER PUBLICATIONS

Extended European Search Report received in EP Application No. 23180537.5 on Apr. 10, 2024.
(Continued)

*Primary Examiner* — Gregory A Wilson
(74) *Attorney, Agent, or Firm* — ALG Intellectual Property, LLC

(57) ABSTRACT

A burner includes a mixing chamber having therein a space in which fuel and air are mixed to form a mixture, a chamber lower cover that is coupled to the mixing chamber while covering an opening formed in the mixing chamber in a reference direction and has a combustion opening opened in the reference direction, a porous distribution unit that includes a metallic sintered material, through which the mixture passes in the reference direction, and covers the combustion opening, a distribution plate that has a plurality of distribution through-holes, through which the mixture passing through the porous distribution unit passes, and covers the combustion opening on the downstream side of the porous distribution unit in the reference direction, and an ignition unit that covers the combustion opening on the downstream side of the distribution plate to ignite the mixture passing through the distribution plate.

8 Claims, 11 Drawing Sheets

(51) Int. Cl.

| | |
|---|---|
| ***F23D 14/14*** | (2006.01) |
| ***F23D 14/84*** | (2006.01) |
| ***F23N 5/24*** | (2006.01) |
| ***F24H 1/00*** | (2022.01) |

(56) References Cited

U.S. PATENT DOCUMENTS

| | | | | |
|---|---|---|---|---|
| 2019/0309945 | A1 * | 10/2019 | Chen | F23D 14/145 |
| 2020/0011525 | A1 | 1/2020 | Horikawa et al. | |
| 2020/0271353 | A1 | 8/2020 | Ono | |
| 2025/0207773 | A1 | 6/2025 | Ono et al. | |

FOREIGN PATENT DOCUMENTS

| | | | | | |
|---|---|---|---|---|---|
| CN | 114087609 | A | * | 2/2022 | F23D 14/46 |
| DE | 1936910 | U | | 4/1966 | |
| EP | 2871414 | A1 | * | 5/2015 | F23D 14/045 |
| JP | 2000018525 | A | | 1/2000 | |
| JP | 2001263614 | A | | 9/2001 | |
| JP | 2023173899 | A | | 12/2023 | |
| KR | 1019990052656 | A | | 7/1999 | |
| KR | 1020010025808 | A | | 4/2001 | |
| KR | 20090032686 | A | * | 4/2009 | B23P 17/06 |
| KR | 1020090069192 | A | | 6/2009 | |
| KR | 1020130067238 | A | | 6/2013 | |
| KR | 1020160063102 | A | | 6/2016 | |
| KR | 20200095240 | A | * | 8/2020 | F23D 14/58 |
| KR | 1020200095239 | A | | 8/2020 | |
| KR | 1020200103563 | A | | 9/2020 | |
| KR | 20250013143 | A | | 1/2025 | |
| WO | 2023228440 | A1 | | 11/2023 | |

OTHER PUBLICATIONS

Office Action issued in Korean Patent Application No. 10-2022-0079738 on Nov. 11, 2024.

* cited by examiner

BURNER AND WATER HEATING APPARATUS INCLUDING SAME

CROSS-REFERENCE TO RELATED APPLICATION(S)

This application claims priority from and the benefit of Korean Patent Application No. 10-2022-0079738, filed on Jun. 29, 2022, which is hereby incorporated by reference for all purposes as if set forth herein.

TECHNICAL FIELD

Exemplary embodiments relate to a burner and a water heating apparatus.

BACKGROUND

Water heating apparatuses transfer heat generated by a combustion reaction to water and use this heat for heating water or supplying hot water. The process of introducing water, heating the introduced water, and discharging the heated water is performed through such a water heating apparatus.

The combustion reaction may take place in a burner. In order for the burner to cause the combustion reaction, air and fuel are required. The fuel and air are mixed in a mixing chamber to form a mixture, which creates conditions favorable for forming a flame. Also, after the mixture is distributed through fine holes formed in a distribution plate, ignition occurs, and the flame may be generated along with a combustion reaction. A burner that causes a combustion reaction in this manner is referred to as a premix burner.

The quenching gap, also called the quenching distance, is the lower limit of the distance at which a flame may be maintained when the flame passes between two parallel plates. A hole formed in the distribution plate has a smaller width than the quenching gap of the fuel, and thus, the mixture may be well distributed. Also, it is possible to prevent flash back, that is the reverse flow of flame, from occurring. In the event of the flash back, a fire may occur or the water heating apparatus may fail.

In the case of a water heating apparatus using LNG as a fuel, the quenching gap of the fuel reaches 2 mm. Accordingly, when a distribution plate including a slit having a width smaller than about 2 mm is disposed in the burner, it is possible to prevent flash back while allowing the fuel and air to pass through the distributor plate to form a flame. However, in the case of fuel such as hydrogen, the quenching gap thereof is about 0.6 mm, which is very small compared to that of LNG. Therefore, in the water heating apparatus using hydrogen as a fuel, a distribution plate having a large number of very small slits has to be used to ensure appropriate combustion without the flash back. However, it is practically difficult to form a distribution plate that has a plurality of slits with a width smaller than about 0.6 mm.

SUMMARY

Exemplary embodiments of the present invention provide a burner for a water heating apparatus capable of preventing flash back while using a fuel having a small quenching gap, such as hydrogen, and a water heating apparatus including the burner.

A first exemplary embodiment of the present invention provides a burner including: a mixing chamber having therein a space in which fuel and air are mixed to form a mixture; a chamber lower cover that is coupled to the mixing chamber while covering an opening formed in the mixing chamber in a reference direction and has a combustion opening opened in the reference direction; a porous distribution unit that includes a metallic sintered material, through which the mixture passes in the reference direction, and covers the combustion opening; a distribution plate that has a plurality of distribution through-holes, through which the mixture passing through the porous distribution unit passes, and covers the combustion opening on the downstream side of the porous distribution unit in the reference direction; and an ignition unit that covers the combustion opening on the downstream side of the distribution plate to ignite the mixture passing through the distribution plate.

A second exemplary embodiment of the present invention provides a water heating apparatus including: a burner configured to cause a combustion reaction; and a heat exchanger configured to heat water flowing through the inside using the heat generated by the combustion reaction, wherein the burner includes: a mixing chamber having therein a space in which fuel and air are mixed to form a mixture; a chamber lower cover that is coupled to the mixing chamber while covering an opening formed in the mixing chamber in a reference direction and has a combustion opening that is opened; a porous distribution unit that includes a metallic sintered material, through which the mixture passes in the reference direction, and is located in the combustion opening; a distribution plate which is located in the combustion opening and through which the mixture passing through the porous distribution unit passes; and an ignition unit located in the combustion opening to ignite the mixture that has passed through the distribution plate, wherein the porous distribution unit, the distribution plate, and the ignition unit are arranged in the reference direction.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Figure 1:
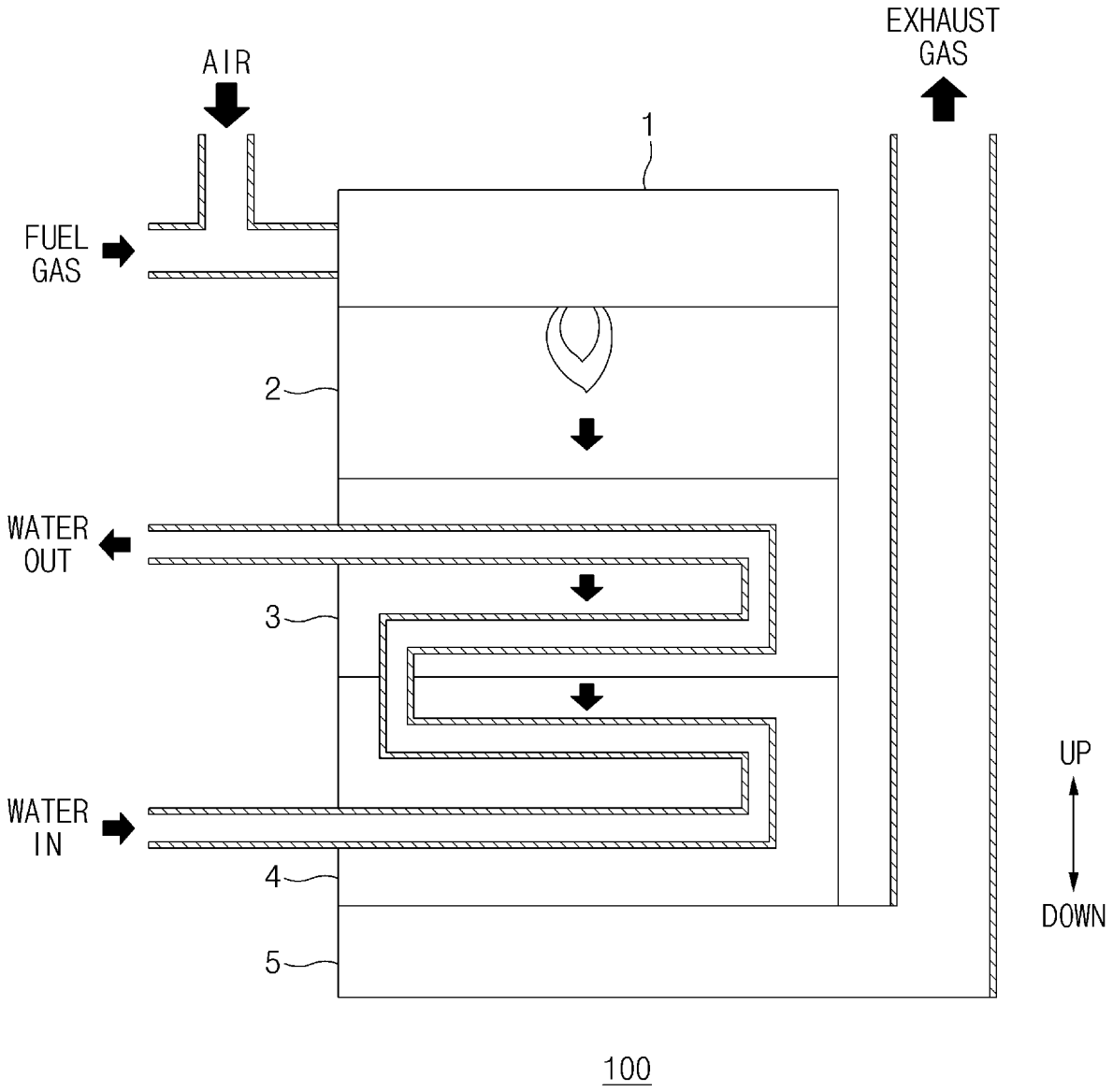
FIG. 1 is a view conceptually showing a water heating apparatus according to an embodiment of the present disclosure.

Hereinafter, exemplary embodiments of the present disclosure are described in more detail with reference to the accompanying drawings. When reference numerals are given to elements in each drawing, it should be noted that the same elements are designated by the same reference numerals if possible although they are shown in different drawings. Also, in describing exemplary embodiments of the present disclosure, a detailed description of related known configurations or functions is omitted when it is determined that the understanding of the exemplary embodiments of the present disclosure is hindered by the detailed description.

In describing components of exemplary embodiments of the present disclosure, terms such as first, second, A, B, (a), and (c) may be used. These terms are only used to distinguish one component from other components, and the characteristics, orders, or sequences of the corresponding components are not limited by the terms. When one component is described as being "connected," "coupled," or "linked" to another component, this component may be directly connected or linked to another component, but it should be understood that other components may be "connected," "coupled," or "linked" between these components.

FIG. 1 is a view conceptually showing a water heating apparatus 100 according to an embodiment of the present disclosure.

The water heating apparatus 100 according to an embodiment of the present disclosure includes a burner 1 and heat exchangers 3 and 4. A direction in which a combustion gas generated by a combustion reaction flows is referred to as a reference direction. As disclosed herein, the reference direction may be a downward direction. The up-down direction, left-right direction, and front-rear direction, which are orthogonal to each other, are defined for convenience of description. These directions may be determined relative to the direction in which the water heating apparatus 100 is oriented. The water heating apparatus 100 may serve as at least one of a boiler or a water heater, but the embodiment is not limited to these examples as long as an apparatus uses heated water.

The water heating apparatus 100 according to an embodiment of the present disclosure may include a combustion chamber 2. The combustion chamber 2 has a combustion space, which is an internal space in which a flame generated by a combustion reaction of the burner 1 may exist. Therefore, the combustion chamber 2 is formed by surrounding the combustion space with sidewalls. On the basis of the flow direction of the combustion gas, the burner 1 is located on the upstream side of the combustion chamber 2, and the heat exchangers 3 and 4 are located on the downstream side of the combustion chamber 2. However, at least a portion of the heat exchangers 3 and 4 may be inserted into the combustion chamber 2. As used herein, the reference direction, which is the flow direction of combustion gas, is described as being downward, but the reference direction is not limited thereto.

The combustion chamber 2 may have a box shape open up and down. On the basis of the reference direction, the burner 1 may be connected to the upstream side of the box shape, and the heat exchangers 3 and 4 may be connected to the downstream side of the box shape. Accordingly, the combustion gas may be generated in the burner 1 and delivered to the heat exchangers 3 and 4 via the combustion chamber 2.

The heat exchangers 3 and 4 heat water by using the heat generated through the combustion reaction. Water to be heated may flow through the inner spaces of the heat exchangers 3 and 4. The heat exchangers 3 and 4 may be divided into a sensible heat exchanger 3 and a latent heat exchanger 4 according to the type of heat used. However, these are possible heat exchanger configurations when the water heating apparatus 100 according to the present disclosure is configured as a condensing boiler. However, when the water heating apparatus is not a condensing boiler, the heat exchanger may not be divided into several configurations.

The sensible heat exchanger 3 is configured to receive heat generated by the combustion reaction in the burner 1 and heat water that flows therethrough. The sensible heat exchanger 3 according to an embodiment may be a fin-tube type heat exchanger that includes a heat exchange pipe and fins penetrated by the heat exchange pipe. Here, the water flows through the inside of the heat exchange pipe, and the combustion gas flows outside of the heat exchange pipe. However, other types of heat exchangers such as plate-type heat exchangers may be used as the sensible heat exchanger 3.

The latent heat exchanger 4 is located on the downstream side of the sensible heat exchanger 3 on the basis of the reference direction and configured to heat water flowing through the inside by using latent heat of the flowing combustion gas generated by the combustion reaction. The combustion gas may be delivered to the latent heat exchanger 4 via the sensible heat exchanger 3. The water may be heated first in the latent heat exchanger 4 and heated secondarily by the sensible heat exchanger 3. Therefore, the heat exchange pipe of the latent heat exchanger 4 communicates with the heat exchange pipe of the sensible heat exchanger 3 and may deliver the heated water to the sensible heat exchanger 3.

The latent heat exchanger 4 may be a plate-type heat exchanger formed by stacking a plurality of plates or may be a fin-tube type heat exchanger that includes a heat exchange pipe and fins penetrated by the heat exchange pipe similarly to the sensible heat exchanger 3. However, the types thereof are not limited thereto.

The water may be delivered to a heating pipe located in a heating target outside the water heating apparatus 100 so as to provide heating thereto. After delivering the heat to the heating target, the water returns to the water heating apparatus 100. Accordingly, a circulating closed circuit may be formed. In addition, the water may be delivered to a hot water heat exchanger through a circulation pipe and used to generate hot water by transferring heat to direct water.

The water heating apparatus 100 according to an embodiment may include a discharge unit 5. The discharge unit 5 may be located on the downstream side of the heat exchangers 3 and 4 on the basis of the reference direction. Condensate water generated in the heat exchangers 3 and 4 may be collected in the discharge unit 5 and then discharged to the outside, and the combustion gas passing through the heat exchangers 3 and 4 may be discharged to the outside via a duct that is a part of the discharge unit 5.

Figure 2:
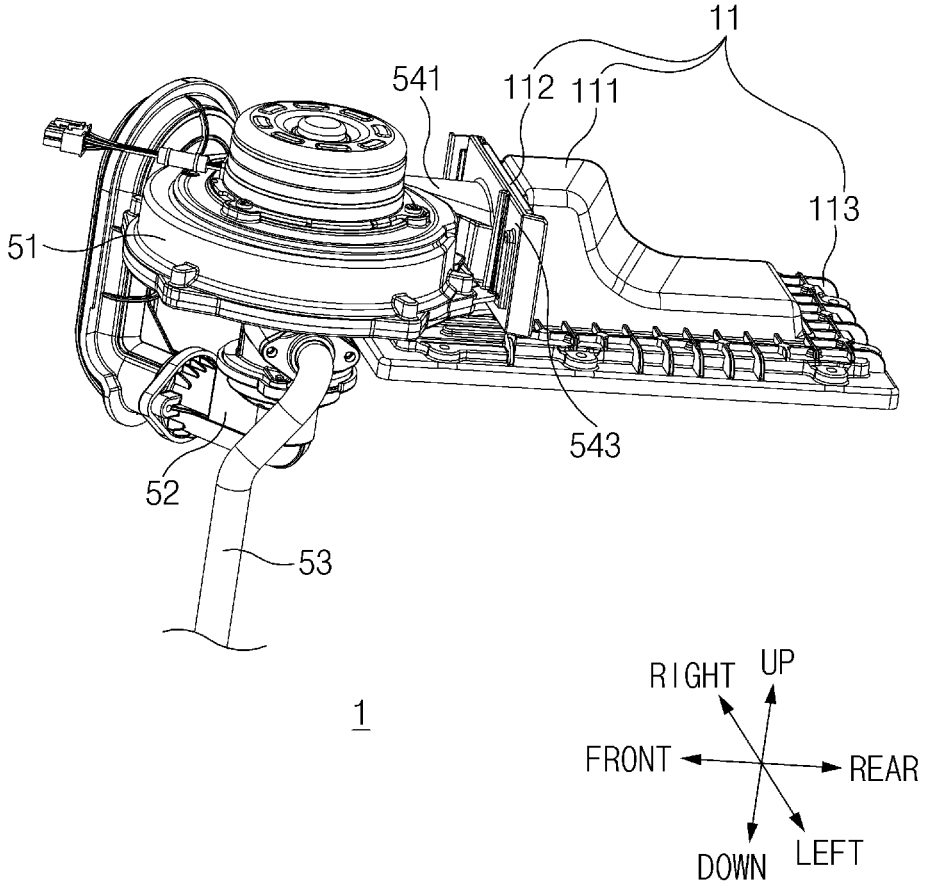
FIG. 2 is a perspective view showing a burner according to an embodiment of the present disclosure.
Figure 3:
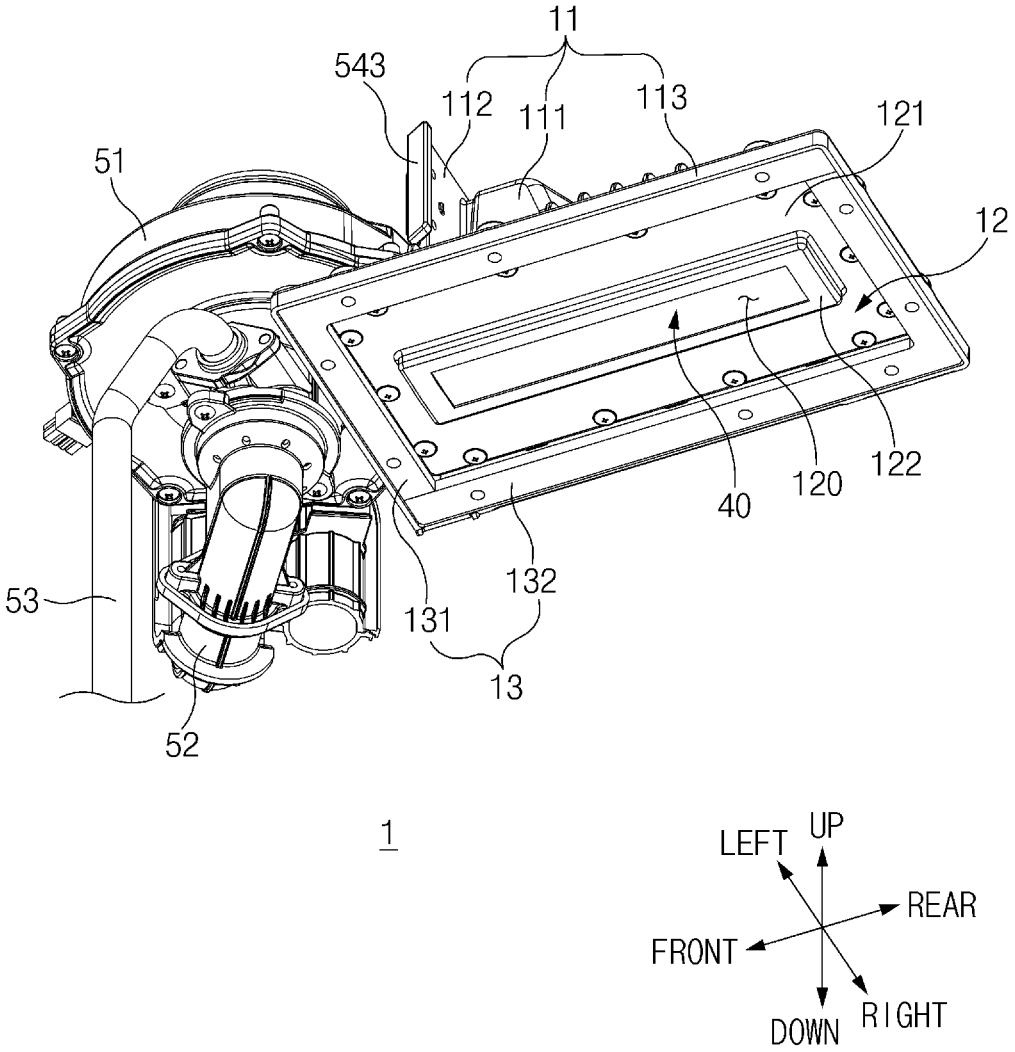
FIG. 3 is a perspective view showing the burner of FIG. 2 from another angle.
Figure 4:
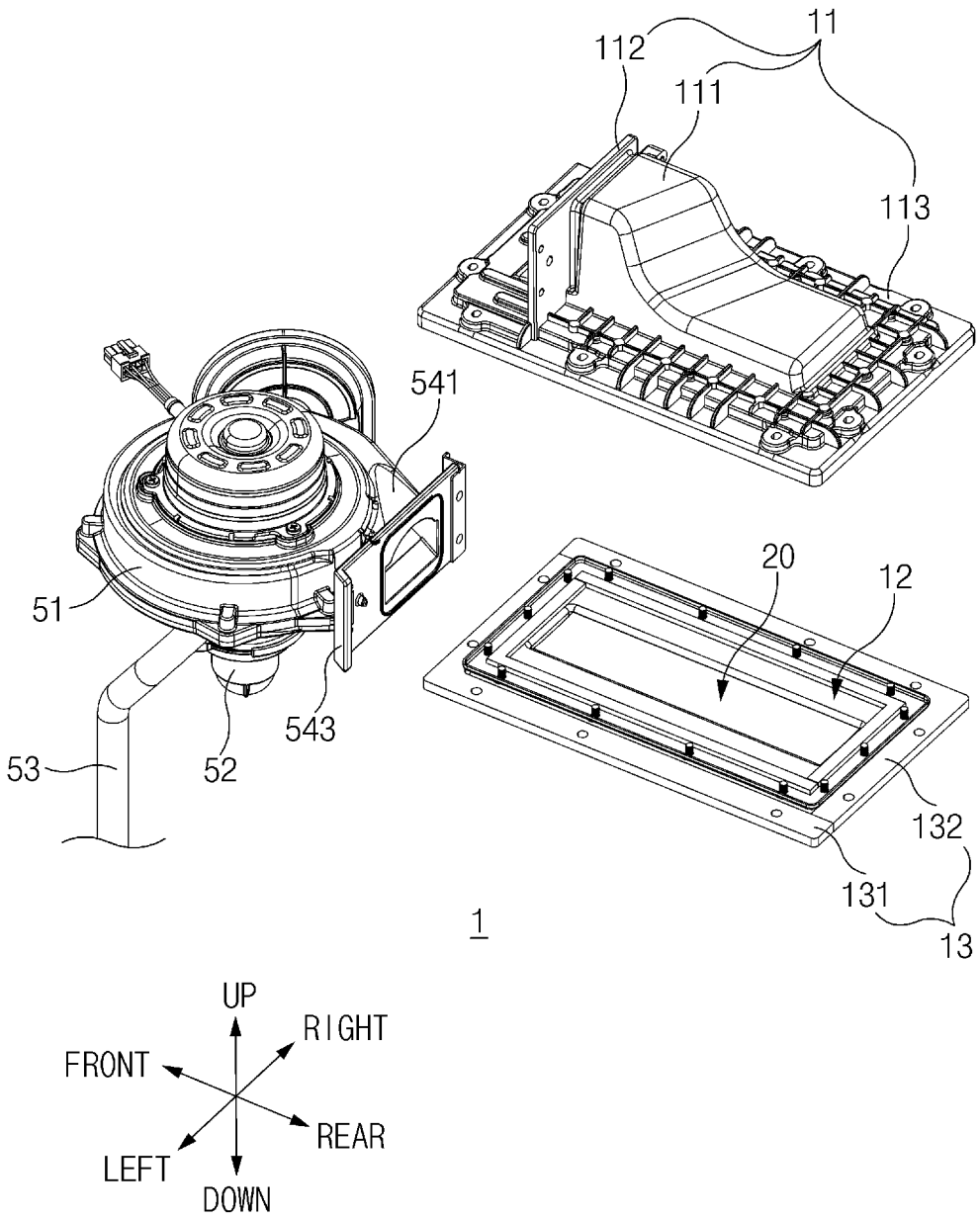
FIG. 4 is a perspective view showing a state in which a portion of the burner according to an embodiment of the present disclosure is exploded.
Figure 5:
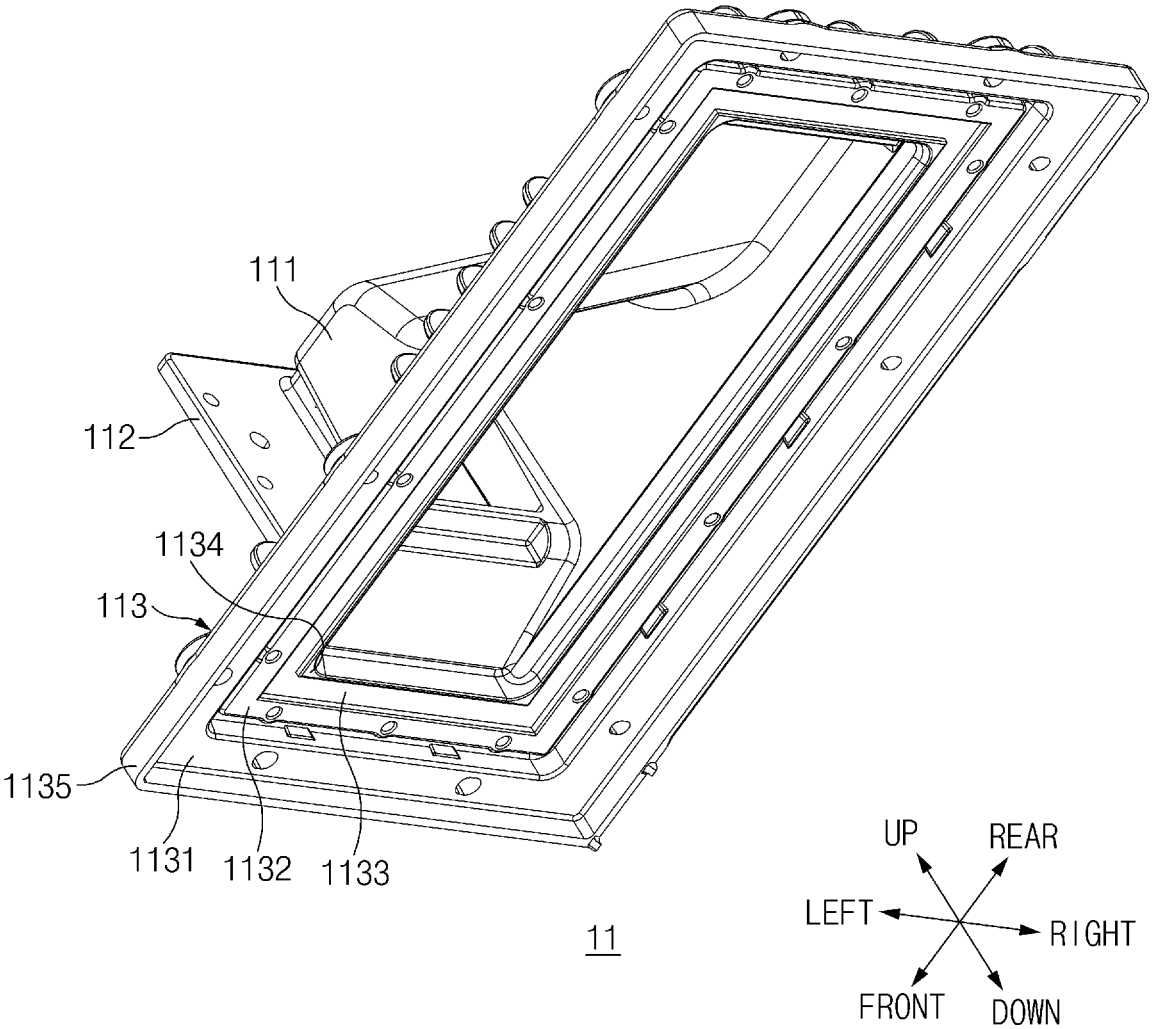
FIG. 5 is a perspective view showing a mixing chamber of a burner according to an embodiment of the present disclosure.

FIG. 2 is a perspective view showing a burner 1 according to an embodiment of the present disclosure. FIG. 3 is a perspective view showing the burner 1 of FIG. 2 from another angle. FIG. 4 is a perspective view showing a state in which a portion of the burner 1 according to an embodiment of the present disclosure is exploded. FIG. 5 shows a mixing chamber 11 of the burner 1 according to an embodiment of the present disclosure.

Referring to the drawings, the burner 1 according to an embodiment may include the mixing chamber 11, a chamber lower cover 12, a porous distribution unit 20, a distribution plate 30, and an ignition unit 40. The burner 1 may include a burner subassembly, and this burner subassembly may include the chamber lower cover 12, the porous distribution unit 20, the distribution plate 30, and the ignition unit 40. The burner 1 is configured to cause a combustion reaction from air and fuel. The fuel may include hydrogen gas, but the embodiment is not limited thereto. The burner 1 may include a spark plug. The spark plug generates a spark in a mixture of air and fuel located adjacent to the ignition unit 40 and ignites the mixture.

Gas Supply Unit 50

The burner 1 according to an embodiment may include a gas supply unit 50. The gas supply unit 50 is connected to the mixing chamber 11 so as to forcibly feed air and fuel into the mixing chamber 11.

The gas supply unit 50 may include an air pipe 52 and a fuel pipe 53 and may also include a blower 51. Each of the air pipe 52 and the fuel pipe 53 may be connected to the blower 51. Air may be provided to the blower 51 via the air pipe 52 and fuel may be provided to the blower 51 via the fuel pipe 53. A compressor or the like for supplying external or stored air may be connected to the air pipe 52, and a fuel tank, a fuel pump, or the like for supplying stored fuel may be connected to the fuel pipe 53.

The blower 51 is operated by receiving electric power and configured to forcibly feed the air and fuel at a certain pressure. Therefore, the blower 51 may include an impeller, a motor, or the like so that the gas is forcibly fed by rotation, but components constituting the blower 51 are not limited thereto. The blower 51 may include a blower case and have an impeller inside the blower case. A wire 62 of a flame temperature acquisition unit 60 described below may be in close contact with the inner surface of the blower case and not come into contact with the impeller. The fuel and air may be mixed with each other in the blower 51 and delivered to the mixing chamber 11.

The gas supply unit 50 may include a gas passage 54. The gas passage 54 may connect the blower 51 to the mixing chamber 11 so that the fuel and air forcibly fed from the blower 51 may be delivered to the mixing chamber 11. The gas passage 54 may include a gas pipe 541 which is connected to the blower 51 and through which the fuel and air discharged from the blower 51 pass. The gas passage 54 may include an inlet cover 543 that is located at an end of the gas pipe 541 and connects the gas pipe 541 to an inlet side of the mixing chamber 11.

Mixing Chamber 11

The fuel and air flow in the mixing chamber 11. The mixing chamber 11 may be connected to the gas supply unit 50. The air and fuel may be supplied from the gas supply unit 50 into the mixing chamber 11. The fuel and air may be mixed in the mixing chamber 11 to form a mixture. A combustion opening 120 may be formed at an end of the mixing chamber 11 in the reference direction. A mixture of fuel and air may be discharged from the mixing chamber 11 to the combustion chamber 2 via the combustion opening 120 in the reference direction.

The mixing chamber 11 may cover an opening formed on the upstream side of the combustion chamber 2 in the reference direction. Accordingly, the burner 1, the combustion chamber 2, and the heat exchangers 3 and 4 may be arranged in this order in the reference direction.

The mixing chamber 11 may include a space forming part 111 and a chamber inlet part 112 in which an inlet port of the mixing chamber 11 is formed. The inner space of the mixing chamber 11 is surrounded by the space forming part 111 and the chamber lower cover 12 to define a chamber space, and the inlet port of the mixing chamber 11 communicating this chamber space with the gas supply unit 50 is formed by passing through the chamber inlet part 112 disposed on one side of the space forming part 111. The chamber inlet part 112 is illustrated as being formed on the front side of the mixing chamber 11 in the drawings, but the location thereof is not limited thereto. The space forming part 111 may have a shape in which a height in the up-down direction decreases with the distance from the inlet port so as to guide the air and fuel introduced through the inlet port.

The mixing chamber 11 may further include an upper plate 113 for covering the combustion chamber 2 downward from above. The upper plate 113 may have a shape that protrudes outward from the lower end of the space forming part 111 in the left-right direction and the front-rear direction. The chamber lower cover 12 may be coupled to the lower surface of the upper plate 113. The combustion chamber 2 may be coupled to an outer region of the lower surface of the upper plate 113 to which the chamber lower cover 12 is coupled.

Specifically, the upper plate 113 may include a chamber flange 1135 that extends from the outermost side in the up-down direction so as to surround the combustion chamber 2, and the lower surface of the upper plate 113 may have an upwardly stepped shape in an inward direction. On the inside of the chamber flange 1135, an outer lower surface 1131 of the upper plate 113 is formed which has a rectangular shape while oriented downward and located above the lower end of the chamber flange 1135. On the inside of the outer lower surface 1131, a middle lower surface 1132 of the upper plate 113 is formed which has a rectangular shape while oriented downward and located above the outer lower surface 1131. On the inside of the middle lower surface 1132, an inner lower surface 1133 of the upper plate 113 is formed which has a rectangular shape while oriented downward and located above the middle lower surface 1132. On the inside of the inner lower surface 1133, a sintering locking part 1134 of the upper plate 113 is formed which is oriented downward, located at the corner of a rectangular opening, and has a curved shape. The sintering locking part 1134 is located above the inner lower surface 1133. However, each of lower surfaces may be formed in the shape having an edge of a polygonal or curved line other than a rectangle. Also, the shape of the sintering locking part 1134 is not limited to the curved shape at the corner of the opening as described above. The sintering locking part 1134 may have various shapes capable of preventing separation of the porous distribution unit 20, such as having a shape of a protrusion that protrudes inward from the inner surface of the opening.

Chamber Lower Cover 12

The chamber lower cover 12 may be coupled to the lower side of the mixing chamber 11. The chamber lower cover 12 may be coupled to the mixing chamber 11 while covering an opening formed downward in the mixing chamber 11. The combustion opening 120 opened in the up-down direction may be formed in the chamber lower cover 12.

The chamber lower cover 12 may include a lower plate 121 and a chamber protrusion part 122. The chamber protrusion 122 may have a downward convex shape and extend in the front-rear direction, and the combustion opening 120 extending in the front-rear direction and opening in the up-down direction may be formed at the center of the chamber protrusion part 122. The porous distribution unit 20, the distribution plate 30, and the ignition unit 40, which are described below, may be positioned inside the chamber protrusion part 122. The lower plate 121 may have a shape that protrudes outward from the upper end of the chamber protrusion part 122 in the left-right direction and the front-rear direction. The lower plate 121 may be coupled to the upper plate 113. An edge of the upper surface of the lower plate 121 may be in contact with the middle lower surface 1132 of the upper plate 113. Also, fasteners are inserted through fastening holes formed on the middle lower surface 1132 and the edge of the upper surface of the lower plate 121, and thus, the mixing chamber 11 and the chamber lower cover 12 may be fastened to each other. The chamber protrusion part 122 and the combustion opening 120 are illustrated as extending in the front-rear direction, but may extend in other directions and have a shape similar to a square.

Packing Material

Figure 6:
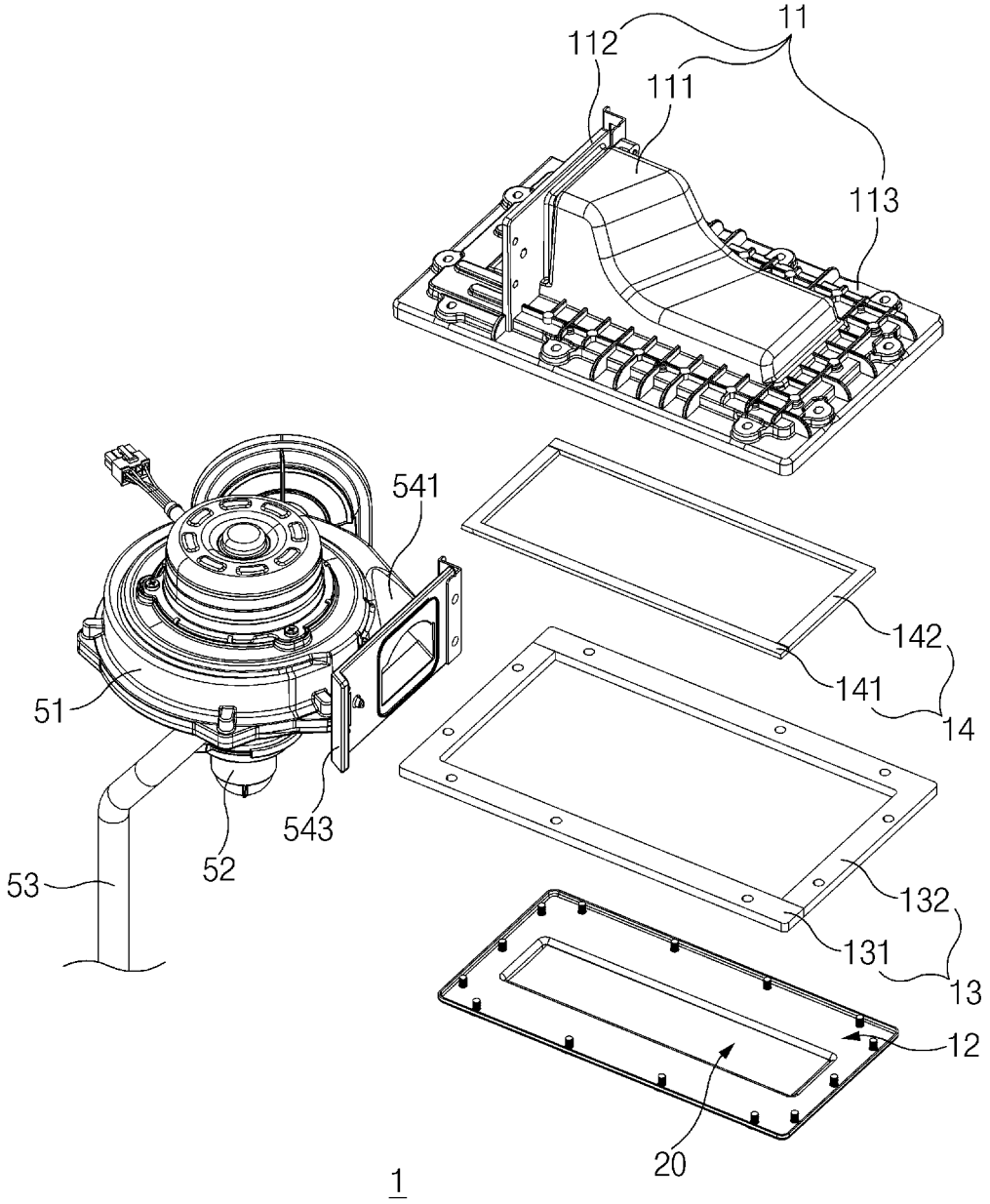
FIG. 6 is a perspective view showing a state in which packing materials are further exploded in the burner of FIG. 4.

FIG. 6 is a perspective view showing a state in which packing materials are further exploded in the burner 1 of FIG. 4.

The burner 1 may include a combustion packing material 13. The combustion packing material 13 is a packing material for maintaining the airtightness at the boundary between the combustion chamber 2 and the burner 1. The combustion packing material 13 has a rectangular rim shape and may be located between the outer lower surface 1131 and the upper end of the combustion chamber 2. Fasteners are inserted into fastening holes formed on the combustion packing material 13 and the outer lower surface 1131, and thus, the combustion packing material 13 and the mixing chamber 11 may be fastened to each other. The combustion packing material 13 may include two combustion packing units 131 and 132 formed in an 'L' shape, such as a first combustion packing material 131 and a second combustion packing material 132. Each of the combustion packing units 131 and 132 may be disposed so that the combustion packing material 13 has an approximately rectangular shape. The combustion packing material 13 may include a material, such as rubber having elasticity that may be pressed and deformed so as to maintain airtightness. The combustion packing material 13 may be formed in the shape having an edge of a polygonal or curved line other than a rectangle.

A chamber packing material 14 is a packing material for maintaining the airtightness at the boundary between the chamber lower cover 12 and the mixing chamber 11. The chamber packing material 14 has a rectangular rim shape and may be located between the inner lower surface 1133 and the upper surface of the lower plate 121 of the chamber lower cover 12. The chamber packing material 14 may include two chamber packing units 141 and 142 formed in an 'L' shape, such as a first chamber packing unit 141 and a second chamber packing unit 142. Each of the chamber packing units 141 and 142 may be disposed so that the chamber packing material 14 has an approximately rectangular shape. The chamber packing material 14 may include a material, such as rubber having elasticity that may be pressed and deformed so as to maintain airtightness. The chamber packing material 14 may be formed in the shape having an edge of a polygonal or curved line other than a rectangle.

Ignition Unit 40 and Distribution Plate 30

Figure 7:
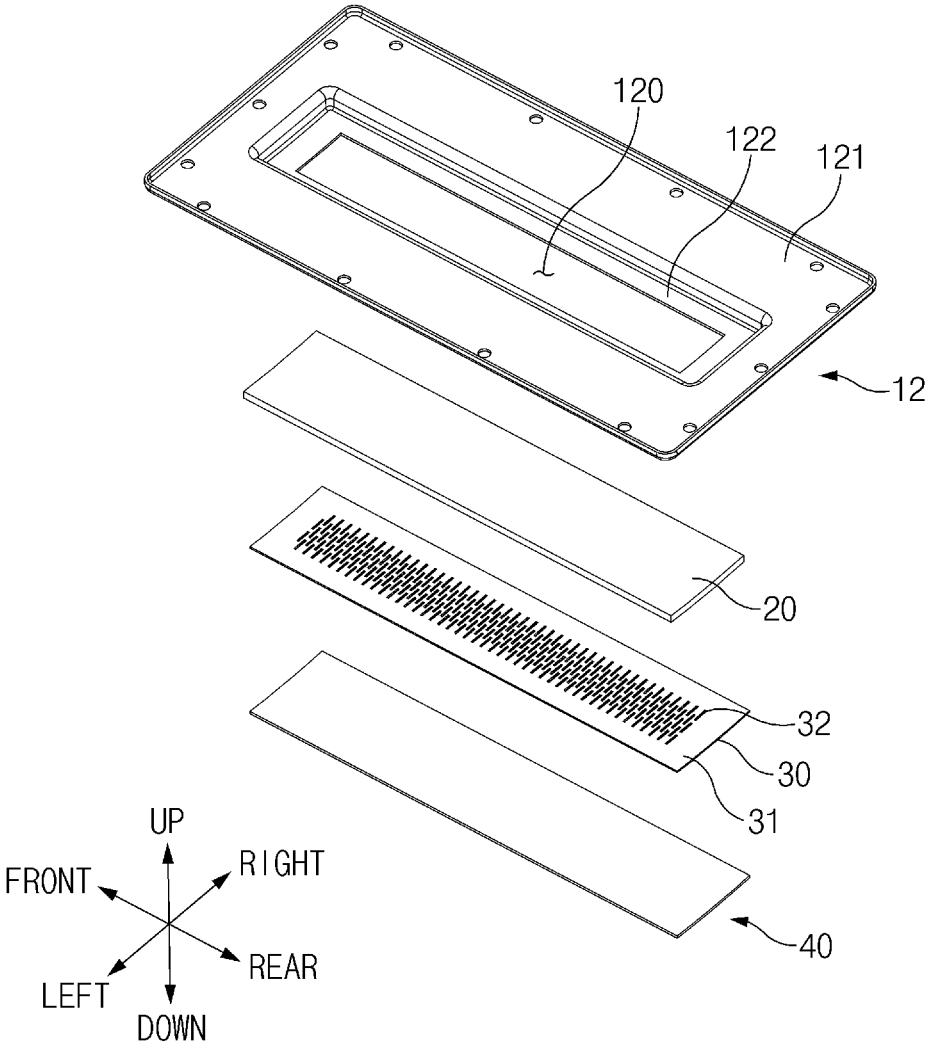
FIG. 7 is an exploded perspective view showing a chamber lower cover and also showing a porous distribution unit, a distribution plate, and an ignition unit separated from the chamber lower cover.
Figure 8:
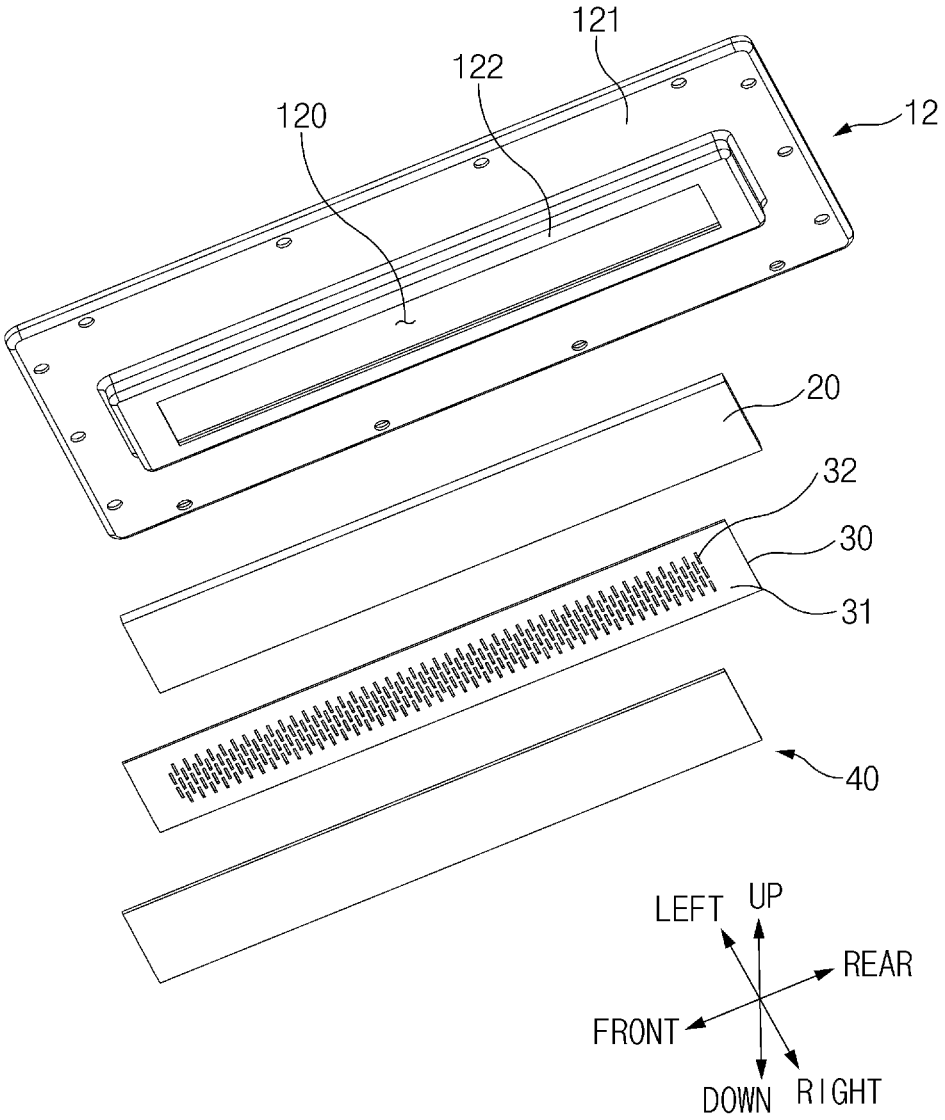
FIG. 8 is a perspective view of the configuration of FIG. 7 when viewed from another angle.

FIG. 7 is an exploded perspective view showing the chamber lower cover 12 and also showing the porous distribution unit 20, the distribution plate 30, and the ignition unit 40 separated from the chamber lower cover 12. FIG. 8 is a perspective view of the configuration of FIG. 7 when viewed from another angle.

The porous distribution unit 20, the distribution plate 30, and the ignition unit 40 may be arranged in the reference direction.

The distribution plate 30 may be configured such that the ignited flame is fixed thereto. The mixture is ejected via the distribution plate 30 and a combustion reaction may occur. The distribution plate 30 covers the combustion opening 120 from the downstream side of the porous distribution unit 20 in the reference direction. The distribution plate 30 has a similar shape to the combustion opening 120 to cover the combustion opening 120. Also, the distribution plate 30 may have a sufficient area for the combustion opening 120 to be located inside the distribution plate 30 when viewed in the up-down direction.

The distribution plate 30 may have a distribution body 31 having a plate shape and a plurality of distribution through-holes 32 described below. Here, the plurality of distribution through-holes 32 are formed by opening the distribution body 31 so that the mixture passing through the porous distribution unit 20 may pass therethrough in the reference direction. The plurality of distribution through-holes 32 may be spaced apart from each other in the front-rear direction and the left-right direction on the distribution plate 30. Each of the distribution through-holes 32 may have a slit shape extending in one of the front-rear direction and the left-right direction. In the description, the distribution through-holes 32 are illustrated as having a shape extending in the left-right direction, but the embodiment is not limited thereto.

The ignition unit 40 may cover the combustion opening 120 from the downstream side of the distribution plate 30 so as to ignite the mixture that has passed through the distribution plate 30. The ignition unit 40 may include a mat that is formed by densely weaving metal fibers so that the generated flame may be easily fixed.

Porous Distribution Unit 20

Figure 9:
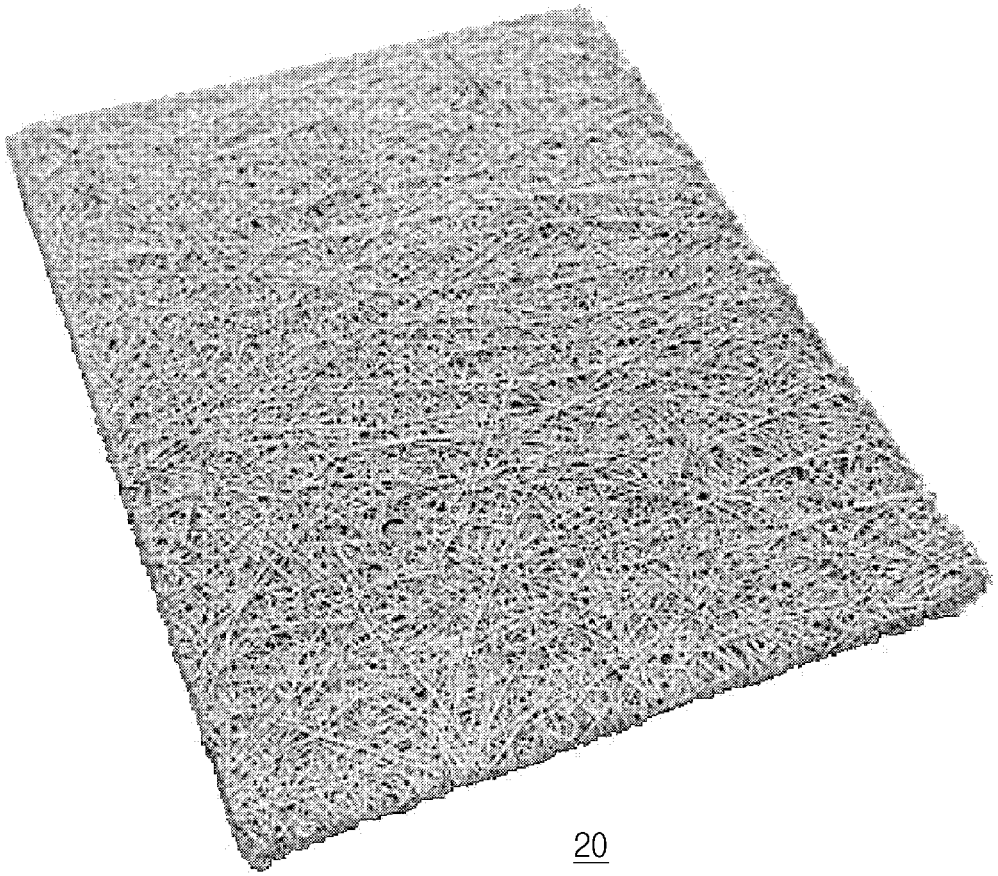
FIG. 9 is a view showing a portion of a porous distribution unit according to an embodiment of the present disclosure.
Figure 10:
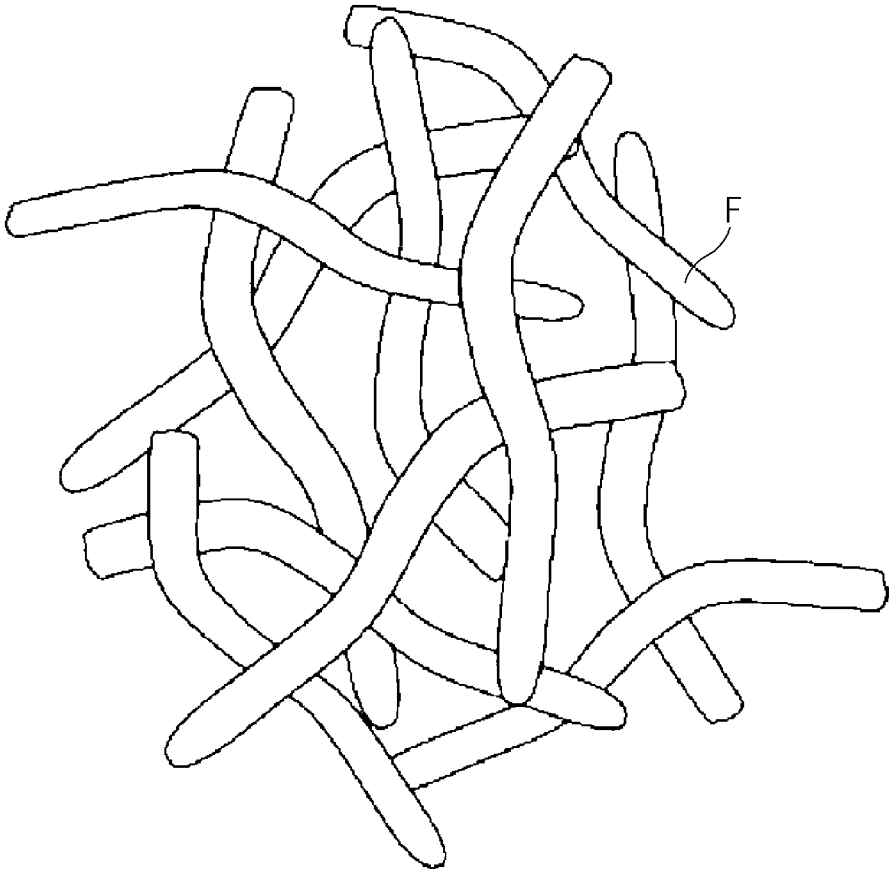
FIG. 10 is an enlarged view of a porous distribution unit according to an embodiment of the present disclosure when the porous distribution unit is formed by using metal fiber.

FIG. 9 is a view showing a portion of the porous distribution unit 20 according to an embodiment of the present disclosure. FIG. 10 is an enlarged view of the porous distribution unit 20 according to an embodiment of the present disclosure when the porous distribution unit 20 is formed by using metal fibers F.

The porous distribution unit 20 includes a porous material through which the mixture may pass in the reference direction. The porous distribution unit 20 may cover the combustion opening 120 above the distribution plate 30. The porous distribution unit 20 is located below the sintering locking part 1134 and locked to the sintering locking part 1134. Accordingly, it is possible to prevent the porous distribution unit 20 from escaping upward. The porous distribution unit 20 may include a metallic sintered material. When including the metallic sintered material, the porous distribution unit 20 may be formed by sintering metal fibers F as shown in FIG. 10. A plurality of through-holes surrounded by these metal fibers F are formed in the porous distribution unit 20. However, the porous distribution unit 20 may include at least one of the metallic sintered material, ceramic, or glass fiber, or any combination thereof. A mat may be made of at least one of the above materials and used as the porous distribution unit 20.

The equivalent diameter of each of through-holes formed in the porous distribution unit 20 may be smaller than a narrow width of each of distribution through-holes 32 having a slit shape and formed in the distribution plate 30, that is, a width of each of distribution through-holes 32 in the front-rear direction. The equivalent diameter of each of through-holes formed in the porous distribution unit 20 may be smaller than a quenching gap of hydrogen gas. The quenching gap of the hydrogen gas is about 0.6 mm, and thus, the equivalent diameter of the through-hole formed in the porous distribution unit 20 may be less than about 0.6 mm. The distribution plate 30 is made of a metal plate or the like, and thus, it may be difficult to manufacture the distribution through-hole 32 into a size smaller than the quenching gap of hydrogen gas. The fuel may pass through the porous distribution unit 20 and the distribution plate 30 in the reference direction and be delivered to the ignition unit 40. In addition, even when flame generated from the fuel passes through the distribution plate 30 in a direction opposite to the reference direction, the flame is not allowed to pass through the porous distribution unit 20. That is, prevention of flash back, which is difficult to achieve by using the distribution plate 30, may be achieved by using the porous distribution unit 20.

Flame Temperature Acquisition Unit 60

Figure 11:
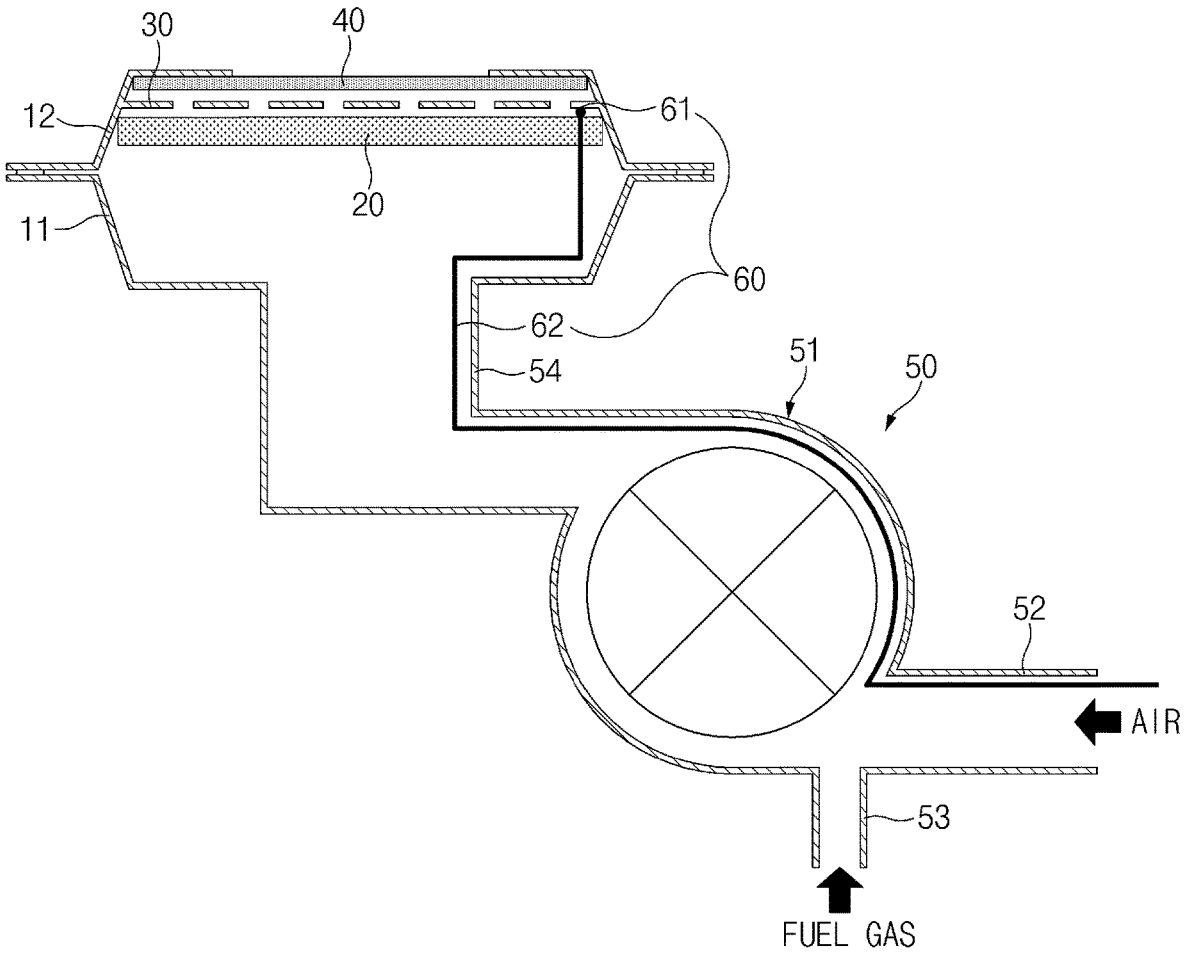
FIG. 11 is a view conceptually showing a burner according to an embodiment of the present disclosure.

FIG. 11 is a view conceptually showing a burner 1 according to an embodiment of the present disclosure.

The burner 1 according to an embodiment may include a flame temperature acquisition unit 60. The flame temperature acquisition unit 60 may be configured to acquire temperature and include a measurement terminal 61 between the porous distribution unit 20 and the ignition unit 40. The measurement terminal 61 of the flame temperature acquisition unit 60 may be in contact with the distribution plate 30. Therefore, the temperature of flame may be acquired by the measurement terminal 61. The measurement terminal 61 may include a thermocouple but may include other components as long as the components may measure the temperature. Since the flame temperature acquisition unit 60 is provided, it is possible to anticipate and deal with flash back by detecting a rapid temperature change in which the flash back occurs. The measurement terminal is generally located outside the mixing chamber 11, but the measurement terminal 61 according to an embodiment is in contact with the distribution plate 30. Accordingly, it is possible to detect a temperature change occurring in a space where the flame is present within a short period of time and quickly respond to the temperature change.

The flame temperature acquisition unit 60 may include a wire 62 electrically connected to the measurement terminal 61. As illustrated in FIG. 11, the wire 62 of the flame temperature acquisition unit 60 may pass through the mixing chamber 11, the gas supply unit 50, and the air pipe 52. The wire 62 may be in close contact with the inner surfaces of the mixing chamber 11, the gas supply unit 50, and the air pipe 52. Accordingly, the risk of fuel leakage from parts related to fuel, such as the fuel pipe 53, due to the arrangement of the wiring 62 may be eliminated.

Processor

The burner 1 according to an embodiment may include a processor. The processor may be electrically connected to the gas supply unit 50 to control the same. The processor may be electrically connected to the flame temperature acquisition unit 60 to control the same. The processor may generate a control signal for controlling the gas supply unit 50 and transmit the control signal to the gas supply unit 50 or may receive electrical signals from electrically connected components. A central processing unit (CPU), a field programmable gate array (FPGA), an application specific integrated circuit (ASIC), or the like may be used as the processor, but the type thereof is not limited thereto.

Here, the expression that members are electrically connected means not only a case in which the members are physically conductively connected to each other so as to send and receive electrical signals or receive power, but also a case in which the members are connected wirelessly so that signals are transmitted therebetween. The processor may be electrically connected to each of components, and thus, the processor may communicate with the components by being connected to the components via wires or by further including a module capable of wireless communication.

Control commands executed by the processor may be stored in a storage medium and utilized. Also, the storage medium may include devices, such as a hard disk drive (HDD), a solid state drive (SSD), a server, a volatile medium, and a nonvolatile medium, but the types of the storage medium are not limited thereto. In addition, data required for the processor to perform tasks may be further stored in the storage medium.

The processor may control the gas supply unit 50 to stop operation of the gas supply unit 50 when the temperature acquired by the flame temperature acquisition unit 60 exceeds a certain limit temperature. Here, the limit temperature represents a temperature of the distribution plate 30 that rapidly increases when the flash back occurs, and this limit temperature may be about 500 degrees Celsius as an example. When a rapid temperature change occurs, the operation of the burner 1 is stopped by the processor, and thus, it is possible to prevent the flash back.

Accordingly, it is possible to prevent flash back while using the fuel having the small quenching gap, such as hydrogen, in the burner of the water heating apparatus.

Even though all the components constituting an exemplary embodiment of the present disclosure have been described as being combined as one body or operating in combination, the present disclosure is not necessarily limited to the exemplary embodiment. That is, within the scope of the objectives of the present disclosure, all the components may be selectively combined into one or more and then operated. Also, terms such as "include," "constitute," or "have" described above may mean that the corresponding components may be included unless explicitly described to the contrary, and thus should be construed as further including other components rather than excluding other components. Unless otherwise defined, all terms including technical or scientific terms have the same meanings as those generally understood by a person skilled in the art to which the present disclosure pertains. Terms used generally, such as terms defined in dictionaries, should be interpreted as having the same meaning as in an associated technical context, and should not be understood abnormally or as having an excessively formal meaning unless defined apparently in the present disclosure.

The technical ideas of the present disclosure have been described merely for illustrative purposes, and those skilled in the art appreciate that various changes and modifications are possible without departing from the essential features of the present disclosure. Therefore, the exemplary embodiments of the present disclosure are to be considered illustrative and not restrictive, and the technical idea of the present disclosure is not limited to the foregoing embodiments. The protective scope of the present disclosure is defined by the appended claims, and all technical ideas within their equivalents should be interpreted as being included in the scope of the present disclosure.

What is claimed is:

1. A burner comprising:

a mixing chamber having therein a space in which fuel and air are mixed to form a mixture;

a chamber lower cover that is coupled to the mixing chamber while covering an opening formed in the mixing chamber in a reference direction and has a combustion opening opened in the reference direction;

a porous distribution unit that comprises a porous material, through which the mixture passes in the reference direction, and covers the combustion opening;

a distribution plate that has a plurality of distribution through-holes, through which the mixture passing through the porous distribution unit passes, and covers the combustion opening on the downstream side of the porous distribution unit in the reference direction;

an ignition unit that covers the combustion opening on the downstream side of the distribution plate to ignite the mixture passing through the distribution plate; and a flame temperature acquisition unit configured to acquire temperature and comprising a measurement terminal located between the porous distribution unit and the ignition unit.

2. The burner of claim 1, wherein an equivalent diameter of each of through-holes formed in the porous distribution unit is smaller than a narrow width of each of distribution through-holes having a slit shape and formed in the distribution plate.

3. The burner of claim 1, wherein an equivalent diameter of each of through-holes formed in the porous distribution unit is smaller than a quenching gap of hydrogen gas.

4. The burner of claim 1, wherein the porous distribution unit comprises at least one of a metallic sintered material, ceramic, or glass fiber, or any combination thereof.

5. The burner of claim 1, wherein the measurement terminal of the flame temperature acquisition unit is in contact with the distribution plate.

6. The burner of claim 1, further comprising a gas supply unit that comprises a blower connected to the mixing chamber to forcibly feed the air and fuel into the mixing chamber, an air pipe connected to the blower to deliver the air to the blower, and a fuel pipe connected to the blower to deliver the fuel to the blower, wherein a wire of the flame temperature acquisition unit passes through the mixing chamber, the blower, and the air pipe.

7. The burner of claim 1, further comprising:

a gas supply unit connected to the mixing chamber to forcibly feed the air and fuel into the mixing chamber; and a processor electrically connected to the gas supply unit and the flame temperature acquisition unit, wherein the processor controls the gas supply unit to stop operation of the gas supply unit when the temperature acquired by the flame temperature acquisition unit exceeds a certain limit temperature.

8. A water heating apparatus comprising:

a burner configured to cause a combustion reaction; and a heat exchanger configured to heat water flowing through the inside using the heat generated by the combustion reaction, wherein the burner comprises:

a mixing chamber having therein a space in which fuel and air are mixed to form a mixture;

a chamber lower cover that is coupled to the mixing chamber while covering an opening formed in the mixing chamber in a reference direction and has a combustion opening that is opened;

a porous distribution unit that comprises a porous material, through which the mixture passes in the reference direction, and is located in the combustion opening;

a distribution plate which is located in the combustion opening and through which the mixture passing through the porous distribution unit passes;

an ignition unit located in the combustion opening to ignite the mixture that has passed through the distribution plate; and a flame temperature acquisition unit configured to acquire temperature and comprising a measurement terminal located between the porous distribution unit and the ignition unit, wherein the porous distribution unit, the distribution plate, and the ignition unit are arranged in the reference direction.

* * * * *